US005707304A

United States Patent [19]

BelleIsle

[11] Patent Number: 5,707,304

[45] Date of Patent: Jan. 13, 1998

[54] HOCKEY PUCK SHOOTING RANGE

[76] Inventor: Merritt E. BelleIsle, 76 Parish Rd., Needham, Mass. 02194

[21] Appl. No.: 761,264

[22] Filed: Dec. 6, 1996

[51] Int. Cl.[6] ..... A63B 69/00

[52] U.S. Cl. ..... 473/431; 473/446

[58] Field of Search ..... 473/422, 431, 473/432, 446, 471

[56] References Cited

U.S. PATENT DOCUMENTS

| | | | |
|---|---|---|---|
| 3,765,675 | 10/1973 | DiMarzio | 473/446 |
| 4,607,842 | 8/1986 | Daoust | 473/446 |
| 5,255,917 | 10/1993 | Morrow et al. | 473/446 |

*Primary Examiner*—William H. Grieb
*Attorney, Agent, or Firm*—John E. Toupal; Harold G. Jarcho

[57] ABSTRACT

A hockey puck shooting range including a planar surface for accommodating sliding movement of hockey pucks; a collection system disposed at a peripheral edge portion of the planar surface and arranged to collect hockey pucks propelled off the planar surface at the peripheral edge portion; and an ejection mechanism for sequentially ejecting hockey pucks onto the planar surface. Also included is a conveyor system for conveying to the ejection mechanism hockey pucks collected by the collection system. The range significantly enhances the effectiveness of puck shooting practice. The range includes a hockey net disposed along the peripheral edge portion and the collection system collects hockey pucks received by the hockey net.

19 Claims, 2 Drawing Sheets

HOCKEY PUCK SHOOTING RANGE

BACKGROUND OF THE INVENTION

This invention relates generally to a hockey training system and, more particularly, to a range for developing the puck shooting skill of hockey players.

The sport of hockey is played extensively in many regions of the world. One important skill desired by hockey participants is an ability to selectively propel a hockey puck in a particular direction required to both evade a protective goalie and access a scoring net. Developing shooting skill during competitive play is difficult in that puck shooting opportunities for individual players are relatively rare. Accordingly, players participate in shooting drills during which each player utilizes a hockey stick to propel a series of pucks into a net. Although the most effective drills employ a goalie to protect the net, the disparity between available goalies and shooters significantly reduces the use of goalies during shooting drills. In addition, the typical practice in which a shooter propels a stationary puck does not reflect actual game conditions during which shots generally are attempted on moving pucks passed along the ice by a teammate. Another problem associated with shooting drills is the highly labor intensive requirement for collection of shot pucks.

The object of this invention, therefore, is to provide an improved, more efficient system for developing hockey puck shooting skill.

SUMMARY OF THE INVENTION

The invention is a hockey puck shooting range including a planar surface for accommodating sliding movement of hockey pucks; a collection system disposed at a peripheral edge portion of the planar surface and arranged to collect hockey pucks propelled off the planar surface at the peripheral edge portion; and an ejection mechanism for sequentially ejecting hockey pucks onto the planar surface. Also included is a conveyor system for conveying to the ejection mechanism hockey pucks collected by the collection system. The range significantly enhances the effectiveness of puck shooting practice.

According to certain features of the invention, the range includes a hockey net disposed along the peripheral edge portion and the collection system collects hockey pucks received by the hockey net. The net provides a realistic target for practice shooters.

According to another feature, the range also includes a mechanical goalie disposed on the planar surface adjacent to an entrance to the hockey net and a drive mechanism for producing movement of the goalie. Game realism is enhanced by the mechanical goalie.

According to yet another feature, the range includes a control mechanism for automatically varying the direction in which hockey pucks are sequentially ejected onto the planar surface. This feature helps simulate actual game conditions.

According to an additional feature, the range includes a sensor for detecting the velocity of hockey pucks propelled into the hockey net. The sensor helps in the evaluation of a shooter's skills.

According to a further feature of the invention, the ejection mechanism is arranged to eject hockey pucks onto a region of the planar surface displaced substantially from the peripheral edge portion. This feature provides pucks in a region in which shots are generally attempted.

According to still other features of the invention, the collection system includes a moving belt disposed adjacent to the peripheral edge portion and arranged for movement toward the conveyor system which includes a conveyor belt movable between the collection system and the ejection means. The belts provide efficient transportation of the hockey pucks.

According to an additional feature of the invention, the moving belt has a width substantially greater than the conveyor belt. This feature minimizes cost of the conveyor system.

According to yet other features of the invention, the collection system further includes a funnelling mechanism for transferring hockey pucks from the moving belt to the conveyor belt and the ejection mechanism includes a rotating brush for propelling pucks and a discharge nozzle for directing them onto the planar surface. The brush and nozzle provide an efficient ejection mechanism.

BRIEF DESCRIPTION OF THE DRAWINGS

These and other objects and features of the invention will become more apparent upon a perusal of the following description taken in conjunction with the accompanying drawings wherein.

BRIEF DESCRIPTION OF PREFERRED EMBODIMENTS

Figure 1:
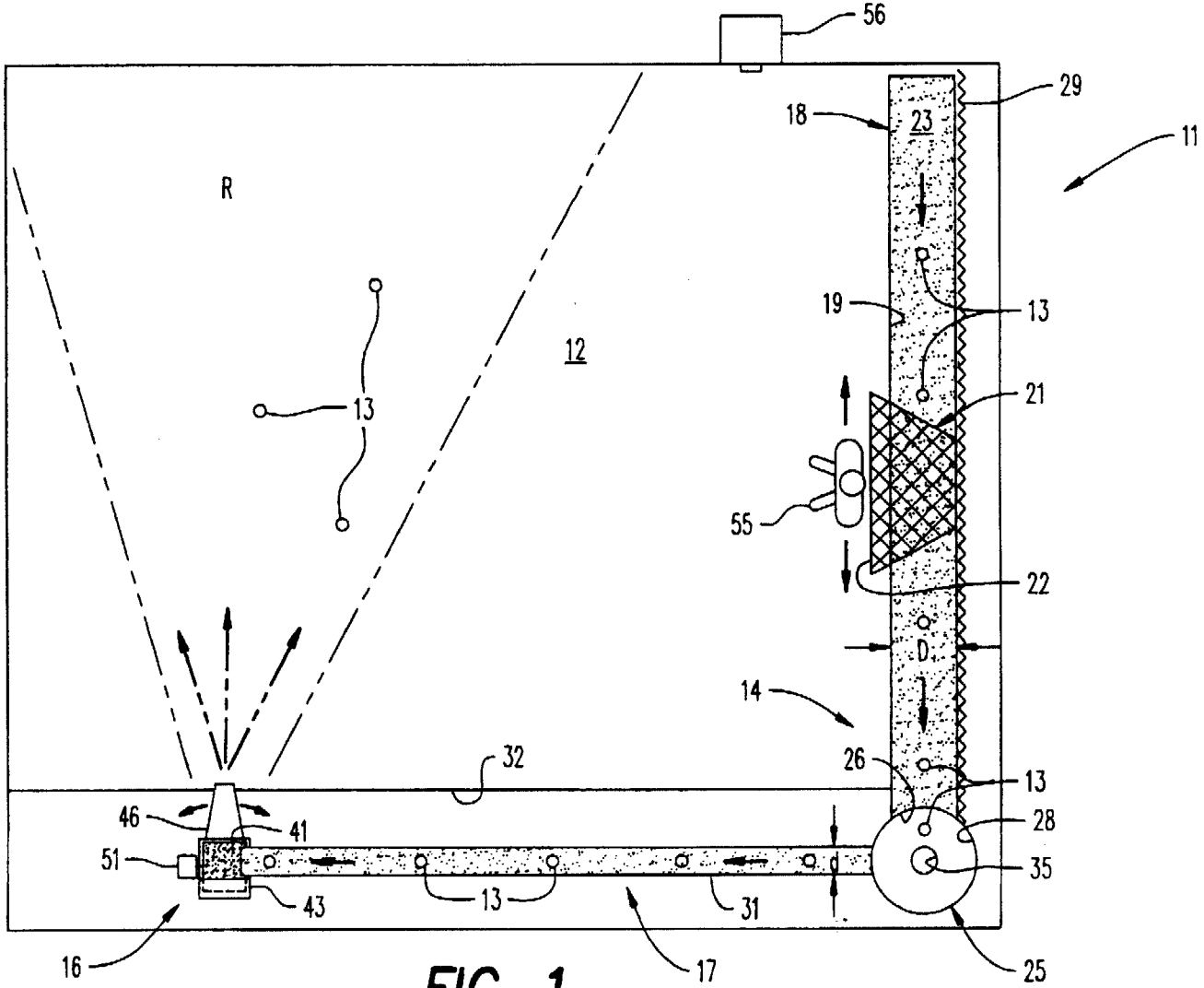
FIG. 1 is a plan view of a puck shooting range according to the invention.

A puck shooting range 11 includes a planar surface 12 for accommodating sliding movement of hockey pucks 13 and a collection system 14 for collecting pucks propelled off the surface 12. Also included in the range 11 is an ejection mechanism 16 for sequentially ejecting pucks 13 onto the planar surface 12 and a conveyor system 17 for conveying to the ejection mechanism 16, pucks 13 collected by the collection system 14 which comprises a moving belt 18.

The planar surface 12 is formed, for example, by a sheet of ice of the type typically provided in hockey rinks. However, the surface 12 can be formed by other materials, such as plastics, preferably capable of establishing sufficient smoothness for accommodating unaltered directional movement of a sliding puck 13. The surface 12 is preferably rectangular, as shown in FIG. 1, and the collection belt 13 is disposed adjacent to a peripheral edge portion 19 thereof. A conventional hockey net 21 is positioned over a central portion of the belt 18 and has an entrance 22 aligned to the edge portion 19.

Figure 2:
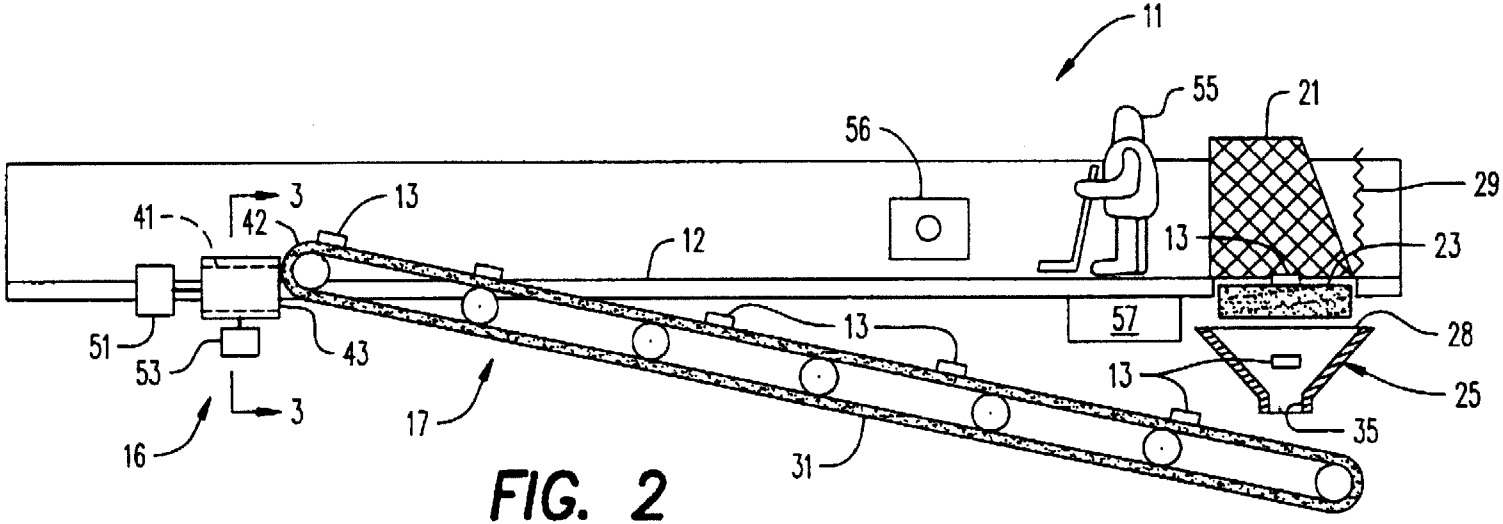
FIG. 2 is a right elevational view of the puck shooting range shown in FIG. 1.

The belt 18 has an upper surface 23 parallel to and about one-half (½) inch below the planar surface 12 as shown in FIG. 2. Also included in the collection system 14 is a funnel 25 mounted vertically adjacent to a discharge end 26 of the belt 18. A mouth 28 of the funnel 25 is disposed to receive pucks 13 falling off the discharge end 26 of the belt 18. Preferably, the belt 18 has a width D substantially equal to the depth of the hockey net 21. A vertical fence 29 is positioned adjacent to an edge of the belt 18 opposite to the planar surface 12.

The conveyor system 17 consists of a conveyor belt 31 extending along another planar surface edge portion 32 that intersects the edge portion 19. A receiving end 33 of the conveyor belt is located below a discharge opening 35 of the funnel 25 so as to intercept pucks 13 falling therefrom. In the interest of economy, the conveyor belt preferably has a width d, (for example six (6) inches), substantially less than the width D of the collection belt 18.

Figure 3:
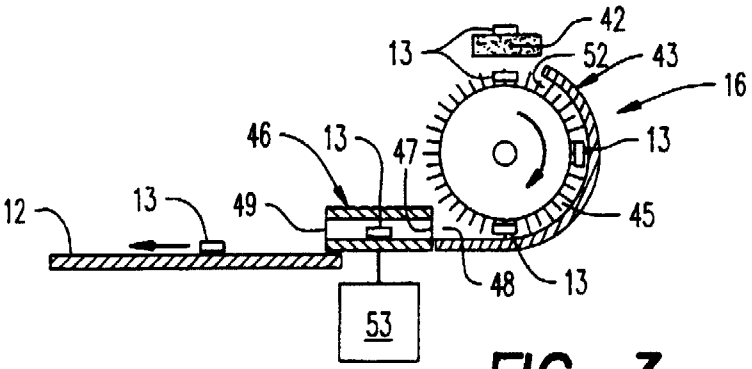
FIG. 3 is a cross-sectional view taken along lines 3—3 of FIG. 2.

The ejection mechanism 16 is depicted more clearly in FIG. 3. A rotatable brush 41 is mounted directly below a discharge end 42 of the conveyor belt 31. Partially enclosing the brush 41 is a semi-cylindrical guide 43. Together, the rotating brush 41 and guide 43 form an arcuate channel 45 having a depth that creates a propelling force on pucks 13 falling off the discharge end of the conveyor belt 31. A nozzle 46 has an entrance 47 aligned with an outlet 48 of the arcuate channel 45 and an exit 49 facing a region R of the planar surface 12 substantially displaced (for example, 25 feet) from the peripheral edge portion 19. Rotation of the brush 41 is produced by a motor 51 and forces pucks 13 into an inlet 52 of the channel 45. In addition, a drive control mechanism 53 is coupled to the nozzle 46 and produces horizontally directed reciprocating movement thereof. The reciprocating movement of the nozzle 46 automatically varies the direction in which pucks 13 are ejected from the exit 49 onto the region 51 of the planar surface 12.

Other components of the shooting range 11 are a mechanical goalie 55 disposed adjacent to the entrance 22 of the net 21 and a sensor 56 for detecting the speed of pucks 13 propelled across the planar surface 12. A drive mechanism 57 is coupled to the goalie 55 and produces reciprocating movement thereof in front of the entrance 22 to the net 21. The sensor 56 is conventional and can be, for example, the type of gun used to detect the speed of pitched baseballs.

Prior to use of the shooting range 11, the belts 18 and 31 are activated, the motor 53 is energized to induce rotation of the brush 41, the control mechanism 53 is activated to produce reciprocating movement of the nozzle 46 and the drive mechanism 57 is energized to cause reciprocating movement of the goalie 55. Also, the sensor 56 can be activated if puck velocity data is desired. Next, an individual practice shooter, preferably wearing ice skates, takes a position in the region R and a supply of pucks 13 is spread out on the conveyor belt 31. After being conveyed to the ejection mechanism by the moving belt 31, each puck 13 falls onto the rotating brush 41, is forced thereby through the channel 45 and ejected through the nozzle 46 onto the surface 12 in a direction determined by the current position of the nozzle 46. The shooter occupying the region R moves to intercept the moving puck and utilizes a hockey stick to propel it toward the net 21. For each shot, the shooter attempts to produce a puck trajectory that will evade the moving goalie 55.

Propelled pucks 13 which enter the net 21 are deflected thereby onto the collection belt 18 while those inadvertently driven to either side of the net 21 also are deposited on the belt 18 after being stopped by the fence 29. The retrieved pucks 13 are transported to the discharge end 26 of the collection belt 18 and deposited in the mouth 28 of the funnel 25. After passing through the discharge opening 25, each puck 13 is returned by the conveyor belt 31 to the ejection mechanism 16 for another ejection onto the surface 12. Pucks obstructed by the goalie 55 can be manually positioned on either of the belts 18 or 31 for return to the ejection mechanism 16.

Obviously, many modifications and variations of the present invention are possible in light of the above teachings. It is to be understood, therefore, that the invention can be practiced otherwise than as specifically described.

What is claimed is:

1. A hockey puck shooting range comprising:

a planar surface for accommodating sliding movement of hockey pucks;

collection means disposed at a peripheral edge portion of said planar surface, said collection means arranged to collect hockey pucks propelled off said planar surface at said peripheral edge portion;

ejection means for sequentially ejecting hockey pucks onto said planar surface, said ejection means being arranged to eject hockey pucks onto a region of said planar surface displaced substantially from said peripheral edge portion; and conveyor means for conveying to said ejection means hockey pucks collected by said collection means.

2. A shooting range according to claim 1 including a hockey net disposed along said peripheral edge portion, and wherein said collection means collects hockey pucks received by said hockey net.

3. A shooting range according to claim 2 including a mechanical goalie disposed on said planar surface adjacent to an entrance to said hockey net.

4. A shooting range according to claim 3 including a goalie drive mechanism for producing movement of said goalie.

5. A shooting range according to claim 1 including ejector control means for automatically varying the direction in which hockey pucks are sequentially ejected onto said planar surface.

6. A shooting range according to claim 5 including a hockey net disposed along said peripheral edge portion, and wherein said collection means collects hockey pucks received by said hockey net.

7. A shooting range according to claim 6 including a mechanical goalie disposed on said planar surface adjacent to an entrance to said hockey net.

8. A shooting range according to claim 7 including a goalie drive mechanism for producing movement of said goalie.

9. A shooting range according to claim 8 including sensing means for detecting the velocity of hockey pucks propelled into said hockey net.

10. A shooting range according to claim 1 wherein said collection means comprises a moving belt disposed adjacent to said peripheral edge portion and arranged for movement toward said conveyor means.

11. A shooting range according to claim 10 wherein said conveyor means comprises a conveyor belt movable between said collection means and said ejection means.

12. A shooting range according to claim 11 wherein said moving belt has a width substantially greater than said conveyor belt.

13. A shooting range according to claim 12 wherein said collection means further comprises a funnelling means for transferring hockey pucks from said moving belt to said conveyor belt.

14. A shooting range according to claim 13 wherein said ejection means comprises a rotating brush and a discharge nozzle, and said rotating brush is arranged to receive hockey pucks from said conveyor belt and eject the hockey pucks out of said discharge nozzle.

15. A shooting range according to claim 14 including control means for producing reciprocating movement of said discharge nozzle so as to vary the direction in which hockey pucks are ejected onto said planar surface.

16. A shooting range according to claim 15 including a hockey net disposed along said peripheral edge portion, and wherein said collection means collects hockey pucks received by said hockey net.

17. A shooting range according to claim 16 including a mechanical goalie disposed on said planar surface adjacent to an entrance to said hockey net.

18. A shooting range according to claim 17 including a goalie drive mechanism for producing movement of said goalie.

19. A shooting range according to claim 18 including sensing means for detecting the velocity of hockey pucks propelled into said hockey net.

* * * * *